US006315139B1

(12) United States Patent
Kreher

(10) Patent No.: US 6,315,139 B1
(45) Date of Patent: Nov. 13, 2001

(54) DEVICE FOR ELASTICALLY SUPPORTING THE COUPLING SHAFT OF A CENTRAL BUFFER COUPLING AT A RAIL-BORNE VEHICLE

(75) Inventor: Joachim Kreher, Braunschweig (DE)

(73) Assignee: Scharfenbergkupplung GmbH & Co. KG (DE)

( * ) Notice: Subject to any disclaimer, the term of this patent is extended or adjusted under 35 U.S.C. 154(b) by 0 days.

(21) Appl. No.: 09/281,123

(22) Filed: Mar. 29, 1999

(30) Foreign Application Priority Data

Mar. 30, 1998 (DE) ..... 198 14 166

(51) Int. Cl.[7] ..... B61G 9/02; B61G 1/00
(52) U.S. Cl. ..... 213/9; 213/75 R
(58) Field of Search ..... 213/7, 9, 22, 23, 213/40 R, 75 R

(56) References Cited

U.S. PATENT DOCUMENTS 3,741,406 * 6/1973 Anderson ..... 213/22
3,799,360 * 3/1974 Huml et al. ..... 213/22
4,136,787 * 1/1979 Forster et al. ..... 213/40
4,739,889 * 4/1988 Bomgardner ..... 213/43

* cited by examiner

*Primary Examiner*—S. Joseph Morano
*Assistant Examiner*—Robert J. McCarry, Jr.
(74) *Attorney, Agent, or Firm*—McGlew and Tutle, P.C.

(57) ABSTRACT

A device for elastically supporting the coupling shaft (4) of a central buffer coupling at a rail-borne vehicle with a spring apparatus is provided, which is formed by rings (9) arranged one behind another at mutually spaced locations in the longitudinal direction of the coupling shaft and vertically. The pretensioned rings (9) are held in annular rings (5, 6) of the coupling shaft (4) and of the housing (3). To improve the generation and the adjustability of the pretension of the spring apparatus of the device, the coupling shaft (4) has a collar (11), with which a pretensioning ring (12) is in contact with its rear side, on the one hand, and, and with which the ring (9) located closest to the opening of the housing (3) is in contact, on the other hand, with its front side, wherein the pretensioning ring (12) pretensions the rings (9) in the longitudinal direction of the coupling shaft (4) in the unloaded state of the device.

20 Claims, 2 Drawing Sheets

DEVICE FOR ELASTICALLY SUPPORTING THE COUPLING SHAFT OF A CENTRAL BUFFER COUPLING AT A RAIL-BORNE VEHICLE

FIELD OF THE INVENTION

The present invention pertains to a device for elastically supporting the coupling shaft of a central buffer coupling at a rail-borne vehicle and more particularly to a device wherein the coupling shaft is supported both in the direction of its axis against tensile forces acting on the central buffer coupling and in the vertical direction in relation to the rail-borne vehicle.

BACKGROUND OF THE INVENTION

Such a device has been known from, e.g., DE 27 01 984 A1. In this device, the coupling shaft is supported both against the tensile and impact forces in the direction of its axis and in the vertical direction in relation to the rail-borne vehicle. The device also has a housing, which is open toward the central buffer coupling, whose axis extends in the longitudinal direction of the vehicle, and into which the coupling shaft extends coaxially at a radially spaced location from the inner circumferential surface of the housing. Pretensioned, elastic rings made of an elastic material are provided between the circumferential surfaces of the coupling shaft and the inner circumferential surfaces of the housing. The rings are aligned vertically with their center planes and are arranged at mutually spaced locations in the longitudinal direction of the shaft. The rings are held in the intermediate spaces between two adjacent, circular annular rings on the circumferential surface of the coupling shaft as well as on the inner circumferential surface of the housing in relation to the coupling shaft and the housing. The housing and the coupling shaft as well as the rings have an elongated round cross section, whose greatest diameter is located in the horizontal center plane of the housing and of the coupling shaft. The housing is divided in its horizontal center plane into two half shells, which are connected to one another by means of detachable fastening means. The rings are slit in the horizontal center plane of the housing at least on one side, and each ring is in contact with both the circumferential surface of the coupling shaft and the inner circumferential surface of the housing. In the unloaded state of the device, i.e., when no tensile or impact forces act on the device, the annular rings of the coupling shaft are flush with the associated annular rings of the housing.

In this device of this class, it is difficult to impose a specific, reproducible pretension in terms of amount and direction to the spring apparatus.

SUMMARY AND OBJECTS OF THE INVENTION

The primary object of the present invention is therefore to improve the generation and the adjustability of the pretension of the spring apparatus of the above-described device.

According to the invention, a device is provided for elastically supporting the coupling shaft of a central buffer coupling at a rail-borne vehicle, wherein the coupling shaft is supported both in the direction of its axis against tensile forces acting on the central buffer coupling and in the vertical direction in relation to the rail-borne vehicle. The device has a housing, which is arranged at the rail-borne vehicle, is open toward the central buffer coupling, and into which the coupling shaft coaxially extends at a radially spaced location from the inner circumferential surface of the housing. The housing is provided with elastic rings made of an elastic material, which are pretensioned between the circumferential surface of the housing, which are aligned vertically with their center planes and are arranged one behind the other in the longitudinal direction of the coupling shaft at mutually spaced locations. The annular rings are formed on the inner circumferential surface of the housing one behind the other at mutually spaced locations in the longitudinal direction of the coupling shaft and the rings are held in the intermediate spaces between two adjacent annular rings in relation to the coupling shaft and the housing. The housing is designed as a divided housing, wherein each ring is directly in contact with both the circumferential surface of the coupling shaft and the inner circumferential surface of the housing. The annular rings of the coupling shaft are aligned with the associated annular rings of the housing in the state in which the device is not loaded in terms of tensile and impact forces. The coupling shaft has a collar, with which a said pretensioning ring is in contact, on the one hand, with its rear side, and, on the other hand, with which the ring located closest to the opening of the housing is in contact with its front side. The pretensioning ring pretensions the rings in the longitudinal direction of the coupling shaft in the unloaded state of the device.

The pretensioning ring preferably pretensions the rings in the direction of pressure and impact. The amount of the pretensioning force is preferably higher than the maximum tensile force occurring during operation.

The pretensioning ring may be inserted into a circular trough-shaped recess of the coupling shaft and a similar recess of the housing. The recesses may have guide slopes for the pretensioning ring. The guide slope of the housing is preferably made with a flatter slope in the direction of the housing opening than the opposite guide slope of the coupling shaft.

The pretensioning of the device in the longitudinal direction of the coupling shaft may be performed by connecting the parts of the divided housing. The pretensioning of the device in the longitudinal direction of the coupling shaft may also be performed by means of a thrust piece, which is fastened to and supported on the housing. The thrust piece preferably has an adjusting means for adjusting the pretensioning forces.

The pretensioning ring and/or the rings are preferably slit at least on one side. The separation lines of the pretensioning ring and/or of the rings may be arranged in the horizontal plane of the coupling shaft.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Figure 1:
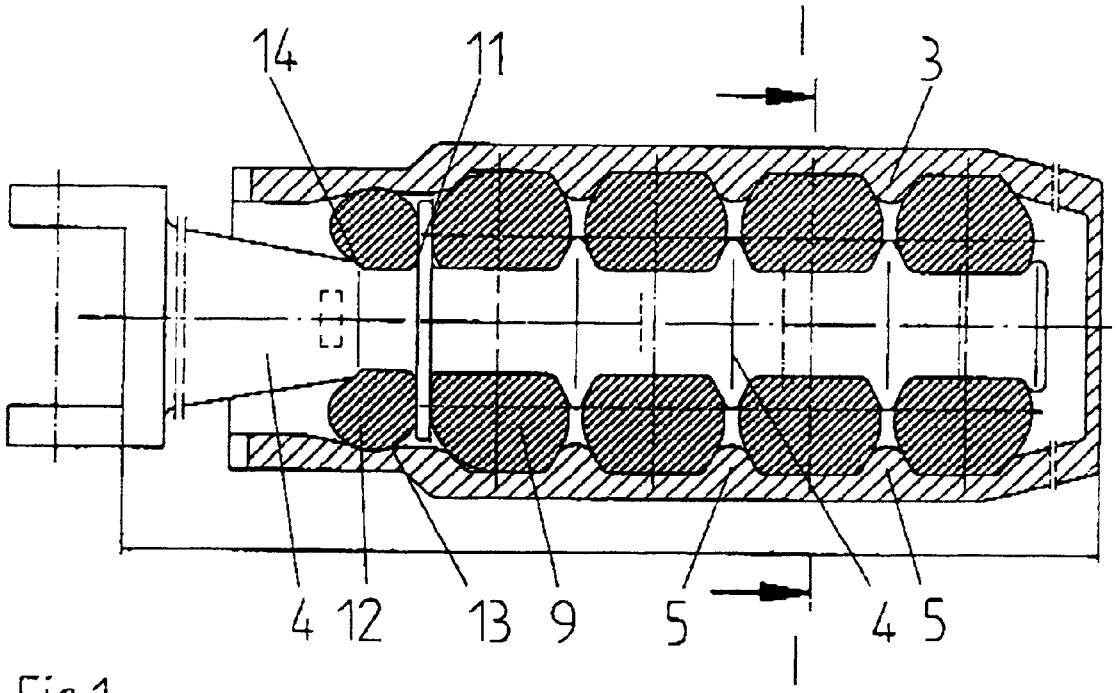
FIG. 1 is a longitudinal section of a device according to the present invention in the unloaded state.

Referring to the drawings in particular, a bearing block 1 fastened to a rail-borne vehicle, not shown, is connected via pins 2 to a housing 3, which coaxially surrounds a coupling shaft 4 carrying a central buffer coupling at a radially spaced location. Both the coupling shaft 4 and the housing 3 preferably have a round cross section or a cross section with a long axis and a short axis, whose greater dimension is arranged in the horizontal center plane of the housing and of the coupling shaft. However, the solution according to the present invention is also applicable to devices of a similar type with any cross section of the housing 3 and the coupling shaft 4.

Both the coupling shaft 4 and the inner circumference of the housing 3 are provided with circular annular rings 6 and 5, respectively, which are aligned with one another in the unloaded state of the device. The ends 7 of the housing 3 are retracted in the inward direction, forming terminal annular rings 5, while the shoulders 8 of the coupling shaft 4 associated with the ends are designed correspondingly. The coupling shaft 4 is held at the predetermined radial distance from the housing 3 by rings 9 made of an elastic material, e.g., rubber or a plastic, which are arranged at right angles to the longitudinal direction of the vehicle and are inserted between the ends 7 and the shoulders 8 and the annular rings 5 and 6.

To facilitate the installation of the rings 9, the housing 3 comprises two half shells, which have identical design and are to be detachably connected to one another by means of screws 10, and the rings 9 are slit on one side or on both sides. In addition, the rings 9 may be installed interferingly with pretension by means of the screws 10 at right angles to the longitudinal direction of the coupling shaft, as a result of which firm seating of the rings 9 can be established between the coupling shaft 4 and the housing 3.

At its section pointing toward the housing opening, the coupling shaft 4 has a collar 11. On one side of the collar 11 a pretensioning ring 12 is in contact with it (the rear side of collar 11), and on the other side of the collar 11 the ring 9 located closest to the opening of the housing is in contact with it (the front side of collar 11). The pretensioning ring 12 pretensions the rings 9 in the unloaded state of the device in the longitudinal direction of the coupling shaft.

The pretensioning ring 12 is inserted in a circular trough-shaped recess 13 of the coupling shaft 4 and in a similar recess 13 of the housing 3. The recesses 13 have guide slopes 14, along which the pretensioning ring 9 (rolling ring) is guided.

The guide slopes 14 of the housing 3 and/or of the coupling shaft 4 are made flatter in the direction of the housing opening than the axially opposite guide slopes 14, which have a maximum angle of 90° with the coupling shaft and pass over into the collar 11.

Figure 2:
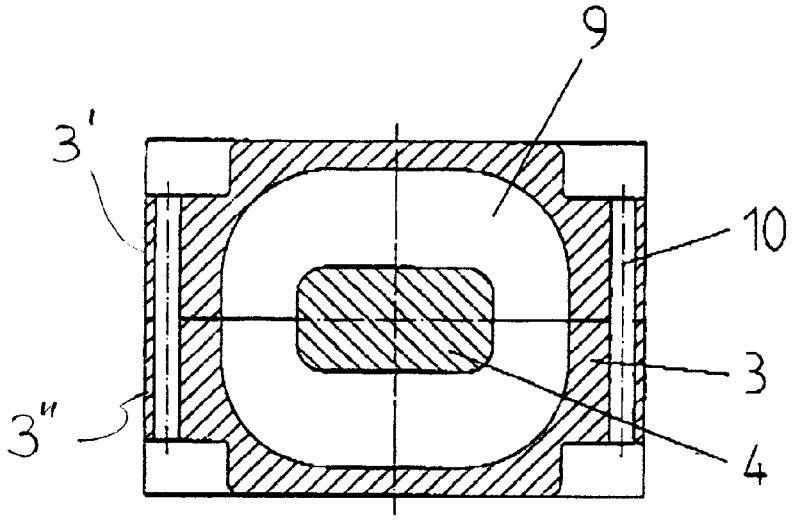
FIG. 2 is a sectional view along line I—I in FIG. 1.

The pretensioning of the device by means of the pretensioning ring 12 in the longitudinal direction of the coupling shaft, i.e., in the direction of pressure and impact, may be performed, as in the exemplary embodiment according to FIG. 1 and FIG. 2, by connecting the parts of the divided housing, usually by means of screws 10.

Figure 3:
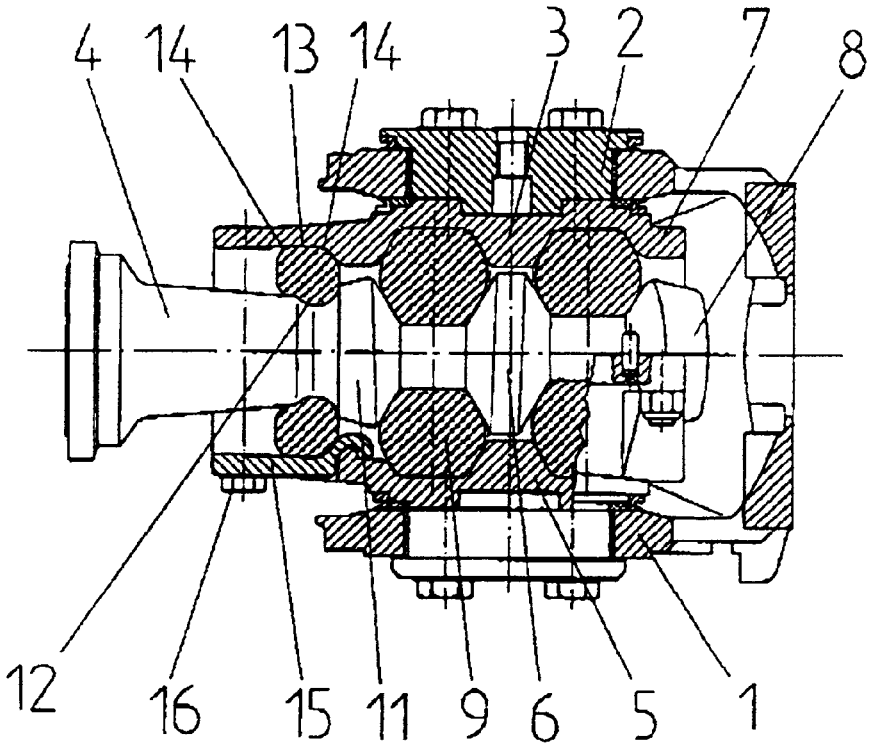
FIG. 3 is a longitudinal sectional view of a second exemplary embodiment of the present invention in the unloaded state.
Figure 4:
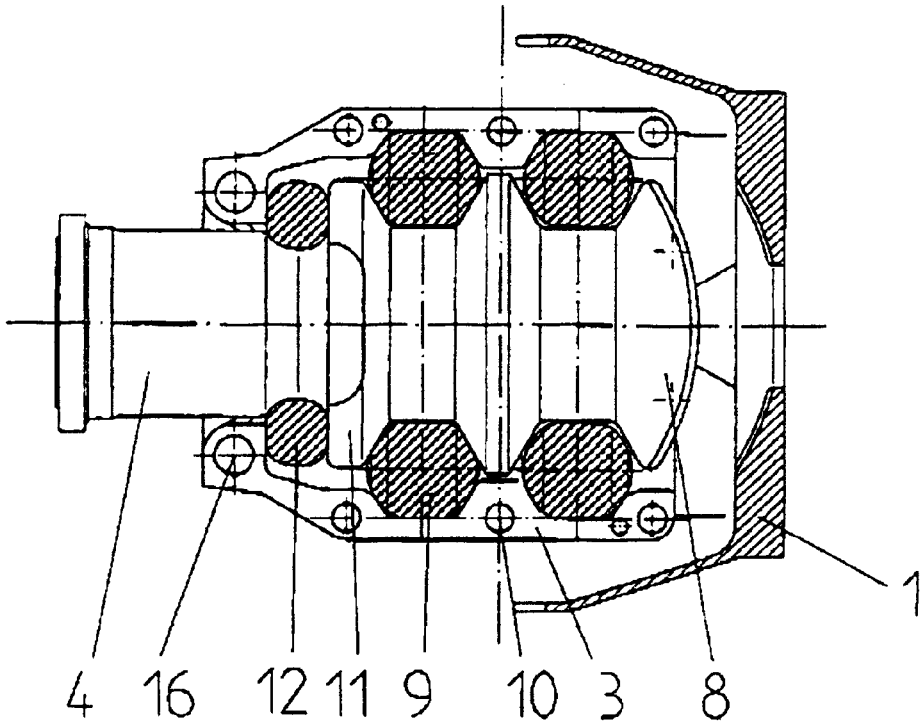
FIG. 4 is a top view of the device according to FIG. 3.

A more accurate and finer setting of the pretension of the device in the longitudinal direction of the coupling shaft, i.e., in the direction of pressure and impact, makes possible a design according to the second exemplary embodiment of the present invention according to FIG. 3 and FIG. 4. The pretensioning force is generated and set in this exemplary embodiment in the longitudinal direction of the coupling shaft 4 via a thrust piece 15, which is fastened to and supported on the housing by means of screws 16. The thrust piece 15 may also have an additional adjusting means (not shown) for fine adjustment.

For use for absorbing different loads, the device may be designed with one or more rings 9.

The number of rings 9 and of the annular rings 5 and 6 is to be determined corresponding to the value of the forces to be absorbed, wherein a larger number of rings 9 makes it possible to absorb stronger forces.

If a tensile force is admitted to the coupling shaft 4, the pretensioning ring 12 is carried by the collar 11 and the rings 9 are carried by the annular rings 6 of the coupling shaft 4. Since, on the other hand, the pretensioning ring 12 and the rings 9 are fixed by the housing 3, the rings 9, 12 are elastically deformed over the entire cross section, but the pretension is first reduced in the pretensioning ring 12 and in the rings 9 by the amount of the tensile force.

The amount of the pretensioning force in the longitudinal direction of the coupling shaft 4, i.e., the coupling shaft 4 is pretensioned in the direction of pressure and impact, is greater than the maximum tensile force occurring on the coupling shaft 4 during operation. It is achieved as a result that the device always remains under a certain pretension even during pressure-tension load cycles, which leads to a quieter, more vibration-free running of the rail-borne vehicles coupled via these devices.

If impact forces are admitted to the coupling shaft 4, the rings 9, which are carried by annular rings 6 of the coupling shaft 4, on the one hand, and are fixed by the annular rings 5 of the housing 3, on the other hand, are elastically deformed over the entire cross section, the rings 9 are first stressed for shear. As the load increases further, the shear stress gradually passes over into a compression stress, because the rings 9 are increasingly compressed between two respective consecutive annular rings 5 and 6, so that the rings 9 are ultimately prevented from undergoing further deformation. A progressive spring characteristic is thus obtained. The pretensioning ring 12 remains essentially unloaded, because the flatter guide slopes 14 in the direction of the housing opening enable it to escape.

Due to its weight and the weight of the central buffer coupling, the coupling shaft 4 is subject to a downwardly directed moment. However, the coupling shaft must always be approximately in a horizontal central position for satisfactory coupling. The pretensioning ring 12 ensures a vertical support, which acts in addition to the support by the rings 9. Longer coupling shafts 4 or heavier weights can therefore be supported without an additional vertical support in the case of designs with a pretensioning ring 12 because of the larger support base.

While specific embodiments of the invention have been shown and described in detail to illustrate the application of the principles of the invention, it will be understood that the invention may be embodied otherwise without departing from such principles.

What is claimed is:

1. A device for elastically supporting the coupling shaft of a central buffer coupling at a rail-borne vehicle, wherein the coupling shaft is supported both in the direction of its axis against tensile forces acting on the central buffer coupling and in the vertical direction in relation to the rail-borne vehicle, the device comprising:

a housing, which is arranged at the rail-borne vehicle and has an opening toward the central buffer coupling, said housing being a divided housing a coupling shaft coaxially extending into the housing at a radially spaced location from the inner circumferential surface of the housing, annular rings being provided on the inner circumferential surface of the housing one behind the other at mutually spaced locations in the longitudinal direction of the coupling shaft and annular rings being provided on the circumferential surface of said coupling shaft and being aligned with the associated annular rings of said housing in a state in which the device is not located in terms of tensile and impact forces, said coupling shaft having a collar;

elastic rings made of an elastic material including an elastic ring disposed closest to said opening, said elastic rings being pretensioned between the inner circumferential surface of the housing and being substantially aligned vertically with center planes of said housing and being arranged one behind the other in said longitudinal direction of the coupling shaft at mutually spaced locations, wherein said elastic rings are held in intermediate spaces between two adjacent annular rings in relation to the coupling shaft and the housing, wherein each elastic ring is directly in contact with both the circumferential surface of the coupling shaft and the inner circumferential surface of the housing;

a pretensioning ring, said collar being in contact with said pretensioning ring at a rear side and being in contact with said elastic ring disposed closest to said opening of said housing at a front side, aid pretensioning ring pretensioning said elastic rings to apply a pretension force said pretension force being exerted on said elastic rings and on said coupling shaft in said longitudinal direction of said coupling shaft.

2. The device in accordance with claim 1, wherein said pretensioning ring pretensions said rings in a direction of pressure and impact.

3. The device in accordance with claim 1, wherein amount of said pretensioning force is higher than the maximum tensile force occurring during operation.

4. The device in accordance with claim 1, wherein said pretensioning ring is inserted into a circular trough-shaped recess of said coupling shaft and a similar recess of said housing.

5. The device in accordance with claim 4, wherein said recesses have a guide slopes for said pretensioning ring.

6. The device in accordance with claim 5, wherein said guide slope of said housing is made with a flatter slope in the direction of the housing opening than the opposite guide slope.

7. The device in accordance with claim 1, wherein said pretensioning in the longitudinal direction of the coupling shaft is performed by connecting parts of said divided housing.

8. The device in accordance with one of the claim 1, further comprising: a thrust piece, which is fastened to and supported on said housing wherein the pretensioning of the device in the longitudinal direction of the coupling shaft is provided by a force applied to said pretensioning ring by said thrust piece.

9. The device in accordance with claim 8, wherein said thrust piece has an adjusting element for adjusting the pretensioning forces.

10. The device in accordance with claim 1, wherein said pretensioning ring and/or said elastic rings are slit at least on one side.

11. The device in accordance with claim 10, wherein separation slit lines of said pretensioning ring and/or of said rings is/are arranged in the horizontal plane of said coupling shaft.

12. A rail-borne vehicle central buffer coupling shaft elastic support device, comprising:

a divided housing arranged at the rail-borne vehicle, said housing having an opening toward the central buffer coupling;

a coupling shaft extending axially into the housing at a radially spaced location from the inner circumferential surface of the housing, said coupling shaft having annular rings provided on the circumferential surface of said coupling shaft, one behind the other at mutually spaced locations in the longitudinal direction of the coupling shaft and said coupling shaft having a collar;

elastic rings made of an elastic material including an elastic ring disposed closest to said opening, said elastic rings being pretensioned radially between the inner circumferential surface of the housing and being substantially aligned vertically with center planes of said housing and being arranged one behind the other in an axial direction of the coupling shaft at mutually spaced locations, wherein at least one of said elastic rings is an intermediate elastic ring held between two adjacent annular rings in relation to the coupling shaft and the housing and one of said elastic rings is disposed closest to said opening of said housing at a front side, wherein each elastic ring is directly in contact with both circumferential surface of the coupling shaft and the inner circumferential surface of the housing;

an axial pretensioning ring, said collar being in contact with said pretensioning ring at a rear side and being in contact with said elastic ring disposed closest to said opening of said housing at a front side, said pretensioning ring applying a pretension force on said collar and said elastic rings in said axial direction of said coupling shaft to support the coupling shaft both in said axial direction against tensile forces acting on the central buffer coupling in said axial direction and in said radial direction.

13. The device in accordance with claim 12, wherein said pretensioning ring pretensions said rings in a direction of pressure and impact.

14. The device in accordance with claim 12, wherein amount of said pretensioning force is higher than the maximum tensile force occurring during operation.

15. The device in accordance with claim 13, wherein said coupling shaft has a circular trough-shaped recess adjacent to said collar and said housing has a corresponding trough-shaped recess, said pretensioning ring being inserted into said circular trough-shaped recess of said coupling shaft and into said corresponding trough-shaped recess of said housing.

16. The device in accordance with claim 15, wherein said recesses each have a guide slope for said pretensioning ring.

17. The device in accordance with claim 16, wherein said guide slope of said housing is made with a flatter slope in the direction of the housing opening than the opposite guide slope.

18. The device in accordance with claim 12, wherein said pretensioning in said axial direction of the coupling shaft is performed by connecting parts of said divided housing.

19. The device in accordance with one of the claim 12, further comprising: a thrust piece, which is fastened to and supported on said housing wherein the pretensioning of the device in said axial direction of the coupling shaft is provided by a force applied to said pretensioning ring by said thrust piece, said thrust piece having an adjusting element for adjusting the pretensioning forces.

20. A rail-borne vehicle central buffer coupling shaft elastic support device, comprising:

a housing first part with a first inner circumferential surface;

a housing second part with a second part inner circumferential surface, said housing first part and said housing second part being connected to form a housing interior with an interior surface provided by said first part inner circumferential surface and said second part inner circumferential surface and an opening toward the central buffer coupling;

a coupling shaft extending axially through said opening and into said housing interior at a radially spaced location from the inner circumferential surface of said housing, said coupling shaft having an outer circumferential surface with an annular rings one behind the other at mutually spaced locations in an axial direction of the coupling shaft, annular rings being provided on the inner circumferential surface of the housing first part and housing second part one behind the other at mutually spaced locations in the longitudinal direction of the coupling shaft to cooperate with said coupling shaft to form annular spaces, said coupling shaft having a collar;

elastic rings made of an elastic material including an elastic ring disposed closest to said opening, each of said elastic rings being disposed in a respective one of said annular spaces and being pretensioned radially between the inner circumferential surface of the housing first part and housing second part and being substantially aligned vertically with center planes of said housing and being arranged one behind the other in said longitudinal direction of the coupling shaft at mutually spaced locations, wherein at least one of said elastic rings is an intermediate elastic ring held between two adjacent elastic rings in relation to the coupling shaft and the housing and one of said elastic rings is disposed closest to said opening of said housing at a front side, wherein each elastic ring is directly in contact with both the circumferential surface of the coupling shaft and the inner circumferential surface of the housing;

an axial pretensioning ring, said collar being in contact with said axial pretensioning ring at a rear side and being in contact with said elastic ring disposed closest to said opening of said housing at a front side, said axial pretensioning ring being positioned in said housing and being pretensioned between the inner circumferential surface of the housing first part and housing second part, one or more of said inner circumferential surface of the housing first part and housing second part and said coupling shaft outer circumferential surface apply a pretension force via said pretension ring and said collar to exert a force on said coupling shaft and said elastic ring disposed closest to said opening in an axial direction of said coupling shaft in the unloaded state of the device, wherein the coupling shaft is supported in said axial direction against tensile forces acting on the central buffer coupling in said axial direction and being supported in said radial direction in relation to the rail-borne vehicle.

* * * * *